US009938687B1

(12) United States Patent
Eckrote

(10) Patent No.: US 9,938,687 B1
(45) Date of Patent: Apr. 10, 2018

(54) ARM ASSEMBLY FOR A WORK VEHICLE WITH SUPPORT ACTUATOR AND STOP

(71) Applicant: CNH Industrial America LLC, New Holland, PA (US)

(72) Inventor: Richard Carter Eckrote, Wichita, KS (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 15/437,289

(22) Filed: Feb. 20, 2017

(51) Int. Cl.

| | |
|---|---|
| ***E02F 3/34*** | (2006.01) |
| ***E02F 3/36*** | (2006.01) |
| ***E02F 9/22*** | (2006.01) |
| ***E02F 9/26*** | (2006.01) |
| ***E02F 9/20*** | (2006.01) |

(52) U.S. Cl.
CPC ..... *E02F 3/369* (2013.01); *E02F 3/3414* (2013.01); *E02F 9/2033* (2013.01); *E02F 9/2271* (2013.01); *E02F 9/264* (2013.01)

(58) Field of Classification Search
CPC ..... E02F 9/2033; E02F 9/2271; E02F 9/264; E02F 3/3414
See application file for complete search history.

(56) References Cited

U.S. PATENT DOCUMENTS 3,982,648 A 9/1976 Luedtke et al.
4,080,746 A * 3/1978 Frazzini ..... E02F 3/3417 414/722
4,352,626 A 10/1982 Frisbee et al.
4,768,917 A 9/1988 Garman
4,947,705 A 8/1990 Yates et al.
5,171,124 A * 12/1992 Foster ..... E02F 3/30 414/722
5,580,208 A * 12/1996 Miller, Sr. ..... A01D 87/0061 414/703
5,807,061 A 9/1998 Donoghue et al.
6,079,938 A * 6/2000 Anderson ..... E02F 3/3414 414/685
6,663,338 B1 * 12/2003 Gregory, Jr. ..... A01B 59/067 414/703
7,226,267 B2 * 6/2007 Johnston ..... E02F 3/3417 414/607

* cited by examiner

*Primary Examiner* — Gerald McClain
(74) *Attorney, Agent, or Firm* — Peter K. Zacharias

(57) ABSTRACT

An arm assembly for a work vehicle includes an arm configured to rotatably couple to a chassis of the work vehicle. The arm includes a substantially vertical portion, and the substantially vertical portion is configured to support an implement. The arm assembly also includes a lift actuator coupled to the arm and configured to couple to the chassis of the work vehicle. The lift actuator is configured to rotate the arm relative to the chassis to control a position of the implement along a vertical axis. In addition, the arm assembly includes a support actuator configured to couple to the chassis. The support actuator is configured to engage the substantially vertical portion of the arm to support the arm against a horizontal load applied to the arm by the implement.

20 Claims, 4 Drawing Sheets

ARM ASSEMBLY FOR A WORK VEHICLE WITH SUPPORT ACTUATOR AND STOP

BACKGROUND

The present disclosure relates generally to an arm assembly for a work vehicle.

Certain work vehicles (e.g., tractors, skid steers, etc.) include a cab configured to house an operator, and a chassis configured to support the cab. The chassis is also configured to support wheels and/or tracks to facilitate movement of the work vehicle relative to a ground surface. In addition, various mechanical components of the work vehicle, such as a motor, a transmission, and a hydraulic system, among other components, may be supported by the chassis and/or disposed within an interior of the chassis. Certain work vehicles (e.g., skid steers) have an arm rotatably coupled to the chassis and configured to support an implement (e.g., dozer blade, bucket, etc.). For example, the arm may support a dozer blade to facilitate earth-moving operations. Accordingly, the horizontal forces experienced by the dozer blade are transmitted to the chassis of the work vehicle through the arm. Unfortunately, the maximum force rating of the dozer blade may be limited due to this arrangement (e.g., due to the maximum horizontal force rating of the arm).

BRIEF DESCRIPTION

In one embodiment, an arm assembly for a work vehicle includes an arm configured to rotatably couple to a chassis of the work vehicle. The arm includes a substantially vertical portion, and the substantially vertical portion is configured to support an implement. The arm assembly also includes a lift actuator coupled to the arm and configured to couple to the chassis of the work vehicle. The lift actuator is configured to rotate the arm relative to the chassis to control a position of the implement along a vertical axis. In addition, the arm assembly includes a support actuator configured to couple to the chassis. The support actuator is configured to engage the substantially vertical portion of the arm to support the arm against a horizontal load applied to the arm by the implement.

In another embodiment, an arm assembly for a work vehicle includes an arm configured to rotatably couple to a chassis of the work vehicle, in which the arm is configured to support an implement. In addition, the arm assembly includes a support actuator having a first end and a second end. The first end is configured to couple to the chassis, the second end is configured to selectively engage the arm to support the arm against a horizontal load applied to the arm by the implement, and the second end is not coupled to the arm.

In a further embodiment, a work vehicle includes a chassis and an arm assembly. The arm assembly includes an arm rotatably coupled to the chassis. The arm includes a substantially vertical portion, and the substantially vertical portion is configured to support an implement. The arm assembly also includes a lift actuator coupled to the arm and to the chassis. The lift actuator is configured to rotate the arm relative to the chassis to control a position of the implement along a vertical axis. In addition, the arm assembly includes a first support actuator coupled to the chassis. The first support actuator is configured to engage the substantially vertical portion of the arm to support the arm against a horizontal load applied to the arm by the implement.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
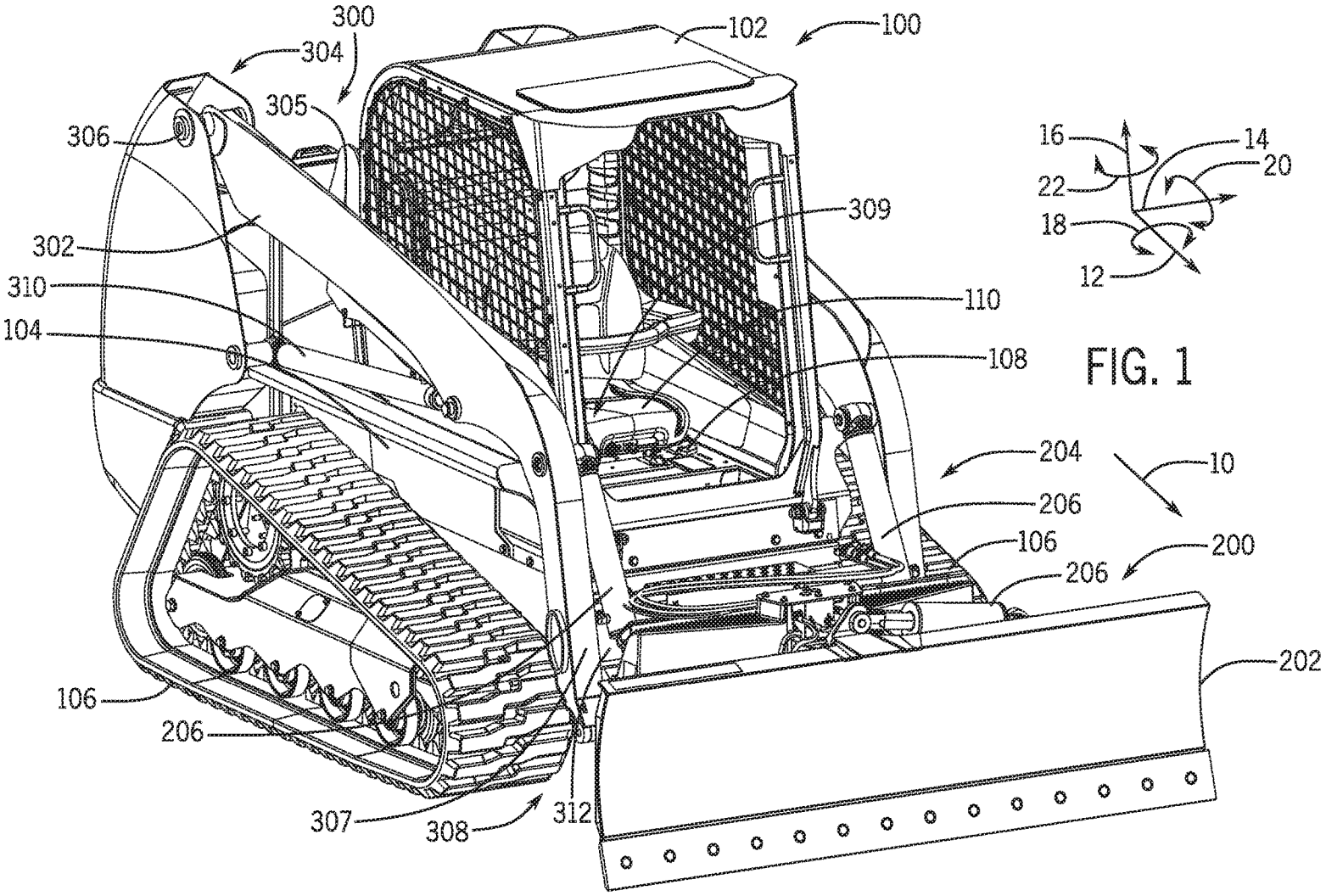
FIG. 1 is a perspective view of an embodiment of a work vehicle having an arm assembly.

FIG. 1 is a perspective view of an embodiment of a work vehicle 100 having an arm assembly. In the illustrated embodiment, the work vehicle 100 is a skid steer. However, it should be appreciated that the arm assembly disclosed herein may be utilized on other work vehicles, such as tractors and dozers, among other work vehicles. In the illustrated embodiment, the work vehicle 100 includes a cab 102 and a chassis 104. In certain embodiments, the chassis 104 is configured to house a motor (e.g., diesel engine, etc.), a hydraulic system (e.g., including a pump, valves, a reservoir, etc.), and other components (e.g., an electrical system, a cooling system, etc.) that facilitate operation of the work vehicle. In addition, the chassis 104 is configured to support the cab 102 and tracks 106. The tracks 106 may be driven to rotate by the motor and/or by component(s) of the hydraulic system (e.g., hydraulic motor(s), etc.). While the illustrated work vehicle 100 includes tracks 106, it should be appreciated that in alternative embodiments, the work vehicle may include wheels or a combination of wheels and tracks.

The cab 102 is configured to house an operator of the work vehicle 100. Accordingly, various controls, such as the illustrated foot controller 108, are positioned within the cab 102 to facilitate operator control of the work vehicle 100. For example, the controls may enable the operator to control the rotational speed of the tracks 106, thereby facilitating adjustment of the speed and/or the direction of the work vehicle 100. In the illustrated embodiment, the cab 102 includes a seat 110 to support the operator during operation of the work vehicle 100.

In the illustrated embodiment, the work vehicle 100 includes a front implement assembly 200 having a front implement, such as the illustrated dozer blade 202. As illustrated, the dozer blade 202 is positioned forward of the chassis 104 relative to a forward direction of travel 10. In addition, the front implement assembly 200 includes a front implement actuator assembly 204 to control a position of the dozer blade 202 relative to the chassis 104. In the illustrated embodiment, the front implement actuator assembly 204 includes hydraulic cylinders 206 configured to move the dozer blade 202 relative to the chassis 104. In addition, the front implement actuator assembly may include a valve assembly configured to control hydraulic fluid flow to the hydraulic cylinders, thereby controlling the position and/or orientation of the dozer blade. In certain embodiments, the front implement actuator assembly 204 may be configured to move the dozer blade 202 along a longitudinal axis 12 of the work vehicle 100, along a lateral axis 14 of the work vehicle 100, along a vertical axis 16 of the work vehicle 100, or a combination thereof. In addition, the front implement actuator assembly 204 may be configured to rotate the dozer blade 202 about the longitudinal axis 12 in roll 18, about the lateral axis 14 in pitch 20, about the vertical axis 16 in yaw 22, or a combination thereof. While the front implement assembly includes a dozer blade in the illustrated embodiment, it should be appreciated that in alternative embodiments, the front implement assembly may include other suitable type(s) of implement(s) (e.g., a bucket, a broom, an auger, a grapple, etc.). In addition, while the front implement actuator assembly includes hydraulic cylinders in the illustrated embodiment, it should be appreciated that in alternative embodiments, the front implement actuator assembly may include other suitable type(s) of actuator(s), such as hydraulic motor (s), pneumatic actuator(s), or electromechanical actuator(s), among others.

In the illustrated embodiment, the work vehicle 100 includes an arm assembly 300 configured to support the implement assembly 200. The arm assembly 300 includes an arm 302 rotatably coupled to the chassis 104 of the work vehicle 100. As illustrated, a first end 304 of the arm 302 is rotatably coupled to the chassis 104 at pivot joints 306, and a second end 308 of the arm 302 is coupled to the implement assembly 200. In the illustrated embodiment, the arm 302 includes a substantially horizontal portion 305, a substantially vertical portion 307, and a transition portion 309 (e.g., curved portion) between the substantially horizontal portion 305 and the substantially vertical portion 307. The first end 304 is positioned on the substantially horizontal portion 305 of the arm 302, and the second end 308 is positioned on the substantially vertical portion 307 of the arm 302. Accordingly, the implement assembly 200 is coupled to the substantially vertical portion 307 of the arm 302. As used herein, substantially horizontal refers to an angle of the arm portion relative to the longitudinal axis 12 of less than 45 degrees, less than 40 degrees, less than 35 degrees, less than 30 degrees, less than 25 degrees, less than 20 degrees, less than 15 degrees, or less than 10 degrees while the arm is in the illustrated fully lowered position. In addition, as used herein, substantially vertical refers to an angle of the arm portion relative to the vertical axis 16 of less than 45 degrees, less than 40 degrees, less than 35 degrees, less than 30 degrees, less than 25 degrees, less than 20 degrees, less than 15 degrees, or less than 10 degrees while the arm is in the illustrated fully lowered position. While the transition portion 309 is curved in the illustrated embodiment, it should be appreciated that in alternative embodiments, the transition portion may have any other suitable shape, such as angled configuration.

The arm assembly 300 also includes lift cylinders 310 (e.g., lift actuators) coupled to the arm 302 and to the chassis 104. The lift cylinders 310 are configured to rotate the arm 302 relative to the chassis 104 to control a position of the implement assembly 200 (e.g., the dozer blade 202 of the implement assembly 200) along the vertical axis 16. While the illustrated embodiment includes two lift cylinders 310, it should be appreciated that in alternative embodiments, the arm assembly may include any suitable number of lift cylinders, such as 1, 2, 3, 4, 5, 6, or more. Furthermore, while the illustrated embodiment utilizes lift cylinder(s) (e.g., hydraulic lift cylinders), it should be appreciated that in alternative embodiments, the arm assembly may include other lift actuator(s) (e.g., electromechanical linear actuator (s), pneumatic actuator(s), hydraulic motor(s), etc.) to control the position of the arm (e.g., instead of the lift cylinder (s) or in addition to the lift cylinder(s)).

As discussed in detail below, the arm assembly may also include a support cylinder (e.g., support actuator) coupled to the chassis 104. The support cylinder is configured to engage the substantially vertical portion 307 of the arm 302 to support the arm against a horizontal load applied to the arm by the implement assembly (e.g., the dozer blade of the implement assembly). For example, in certain embodiments, a stop of the support cylinder is configured to engage a cross-member, such as the cross member 312 on the substantially vertical portion 307, of the arm 302 to support the arm against the horizontal load. Due to the support provided by the support cylinder, a portion of the horizontal load applied by the implement assembly may be transferred to the chassis without passing through the transition portion of the arm and the arm/chassis pivot joints, thereby reducing the bending moment on the transition portion and reducing the load on the arm/chassis pivot joints. As a result, the maximum force rating of the dozer blade may be increased, as compared to a configuration in which the support cylinder is omitted, and the horizontal load is transferred to the chassis only at the arm/chassis pivot joints and, in certain work vehicles, the lift cylinders.

Figure 2A:
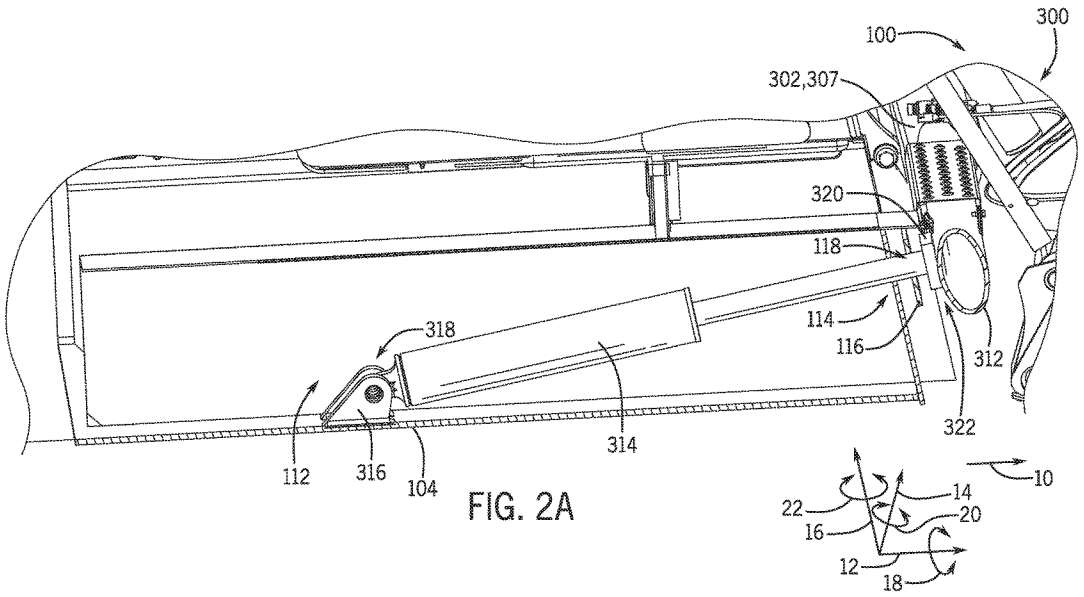
FIG. 2A is a cross-sectional side view of the work vehicle of FIG. 1.

FIG. 2A is a cross-sectional side view of the work vehicle 100 of FIG. 1. As illustrated, the arm assembly 300 includes a support cylinder 314 (e.g., support actuator) coupled to the chassis 104 and configured to engage the arm 302 to support the arm 302 against a horizontal load applied to the arm 302 by the dozer blade. In the illustrated embodiment, the support cylinder 314 is a hydraulic cylinder, which may be controlled by a valve assembly. However, it should be appreciated that in alternative embodiments, the arm assembly 300 may include another suitable type of support actuator, such as an electromechanical linear actuator, a pneumatic cylinder, or a hydraulic motor, among others. In the illustrated embodiment, the support cylinder 314 is partially disposed within a cavity 112 of the chassis 104. However, it should be appreciated that in alternative embodiments, the support cylinder may be positioned at another suitable location on the work vehicle chassis.

In the illustrated embodiment, the arm assembly 300 includes a bracket 316 coupled to the chassis 104 and configured to rotatably couple a first end 318 of the support cylinder 314 to the chassis 104 (e.g. via a pin extending through the first end of the support cylinder and the bracket). However, in alternative embodiments, the first end of the support cylinder may be coupled to the chassis (e.g., rotatably coupled to the chassis or non-rotatably coupled to the chassis) by another connection system (e.g., a welded connection, a track system, etc.). Furthermore, the support cylinder 314 includes a stop 320 at a second end 322 of the support cylinder 314, opposite the first end 318. The stop 320 is configured to contact the cross-member 312 on the substantially vertical portion 307 of the arm 302 to support the arm against the horizontal load applied to the arm by the dozer blade. While the stop is shaped as a substantially flat square plate in the illustrated embodiment, it should be appreciated that in alternative embodiments, the stop may be shaped as a curved flat plate (e.g., to substantially match the contour of the cross-member), a cylinder, or any other suitable shape. In addition, the stop may be formed from any suitable material, such as a resilient material (e.g., a polymeric material, a foam material, etc.) or a substantially rigid material (e.g., metal, a composite material, etc.).

In the illustrated embodiment, the second end 322/stop 320 of the support cylinder 314 is not coupled to the arm 302. Accordingly, the support cylinder may be extended and retracted based on the position of the arm (e.g., target position of the arm), such that the second end/stop engages the arm before the work vehicle initiates earth-moving operations. For example, prior to initiating earth-moving operations, the lift cylinders may be extended or retracted to position the dozer blade at a target height relative to the ground (e.g., based on user input, based on instructions from an automated system, etc.). The support cylinder may then be extended (e.g., from a fully retracted position) until the second end/stop contacts the arm (e.g., the cross-member of the arm). With the second end/stop in contact with the arm, a portion of the horizontal load applied to the arm by the dozer blade may be transferred from the arm to the chassis without passing through the arm/chassis pivot joints. While the second end/stop of the support cylinder is configured to selectively engage the cross-member in the illustrated embodiment, it should be appreciated that in alternative embodiments, the second end/stop may be configured to selectively engage another portion of the arm (e.g., a substantially vertical member of the arm, etc.) to transfer a portion of the horizontal load to the chassis. Furthermore, in certain embodiments, the second end of the support cylinder may be coupled (e.g., rotatably coupled) to the arm (e.g., the cross-member of the arm). In such embodiments, an automatic system may coordinate extension and retraction of the lift cylinder(s) and the support cylinder.

In the illustrated embodiment, the chassis 104 includes an opening 114 configured to facilitate passage of the support cylinder 314 (e.g., a piston rod of the support cylinder) through the chassis 104 from the cavity 112 to the arm 302. In certain embodiments, the opening 114 may be elongated along the vertical axis 16 to enable the support cylinder 314 to rotate in pitch 20 about the first end 318. In the illustrated embodiment, a support 116 coupled to the chassis 104 is configured to support the support cylinder 314. The support 116 has an opening 118 configured to facilitate passage of the support cylinder 314 (e.g., the piston rod of the support cylinder) through the support. In certain embodiments, the opening 118 may be elongated along the vertical axis 16 to enable the support cylinder 314 to rotate in pitch 20 about the first end 318. Contact between the support cylinder (e.g., the piston rod of the support cylinder) and a surface of the support 116 at a bottom end of the opening 118 may block downward rotation of the support cylinder 314 in pitch 20, thereby substantially aligning the stop 320 with the cross-member 312 (e.g., while the stop is separated from the cross-member). While the support cylinder (e.g., the stop of the support cylinder) is engaged with the substantially vertical portion of the arm (e.g., the cross-member of the arm), a portion of the horizontal load applied by the implement assembly may be transferred to the chassis without passing through the transition portion of the arm and the arm/chassis pivot joints, thereby reducing the bending moment on the transition portion and reducing the load on the arm/chassis pivot joints. As a result, the maximum force rating of the dozer blade may be increased, as compared to a configuration in which the support cylinder is omitted, and the horizontal load is transferred to the chassis only at the arm/chassis pivot joints and, in certain work vehicles, the lift cylinders.

Figure 2B:
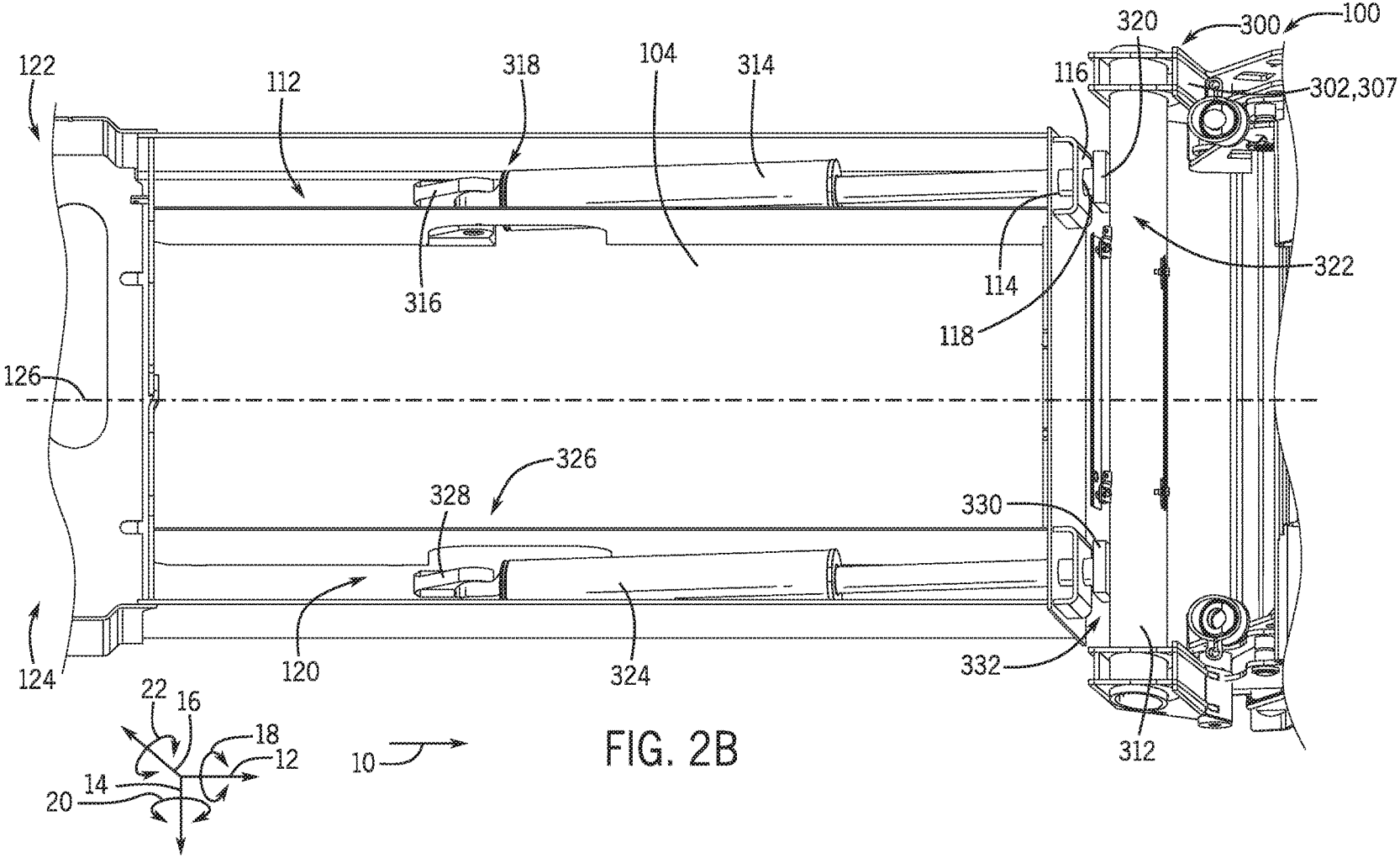
FIG. 2B is a cross-sectional top view of the work vehicle of FIG. 1.

FIG. 2B is a cross-sectional top view of the work vehicle 100 of FIG. 1. As illustrated, the support cylinder 314 is partially disposed within the cavity 112. In addition, the first end 318 of the support cylinder 314 is rotatably coupled to the bracket 316, and the support cylinder 314 includes a stop 320 at the second end 322. As previously discussed, the stop 320 is configured to contact/engage the cross-member 312 on the substantially vertical portion 307 of the arm 302 to support the arm 302 against the horizontal load applied to the arm by the dozer blade.

In the illustrated embodiment, the arm assembly 300 includes a second support cylinder 324 (e.g., support actuator) configured to support the arm 302 against the horizontal load applied to the arm by the dozer blade. As illustrated, the second support cylinder 324 is partially disposed within a second cavity 120. The first cavity 112 is positioned on a first lateral side 122 of the chassis 104, and the second cavity 120 is positioned on a second lateral side 124 of the chassis 104, opposite the first lateral side 122. Accordingly, the first and second cavities are positioned on opposite sides of a longitudinal centerline 126 of the work vehicle 100 along the lateral axis 14. As illustrated, a first end 326 of the second support cylinder 324 is rotatably coupled to a bracket 328, which is coupled to the chassis 104, and the second support cylinder 324 includes a stop 330 at a second end 332 of the second support cylinder 324. The stop 330 is configured to contact/engage the cross-member 312 on the substantially vertical portion 307 of the arm 302 to support the arm 302 against the horizontal load applied to the arm by the dozer blade.

While the illustrated embodiment includes two support cylinders, it should be appreciated that in alternative embodiments, the arm assembly may include more or fewer support cylinders (e.g., 1, 2, 3, 4, 5, 6, or more). Furthermore, while the second support cylinder is configured to contact/engage the cross-member of the arm in the illustrated embodiment, it should be appreciated that in alternative embodiments, the second support cylinder may be configured to contact/engage another portion of the arm (e.g., a vertical member of the arm, etc.) to transfer a portion of the horizontal load to the chassis. In addition, in certain embodiments, the second end of the second support cylinder may be coupled (e.g., rotatably coupled) to the arm (e.g., the cross-member of the arm). In such embodiments, an automatic system may coordinate extension and retraction of the lift cylinder(s) and the support cylinders.

In the illustrated embodiment, the second support cylinder 324 is a hydraulic cylinder, which may be controlled by a valve assembly. However, it should be appreciated that in alternative embodiments, the arm assembly 300 may include another suitable type of second support actuator, such as an electromechanical linear actuator, a pneumatic cylinder, or a hydraulic motor, among others. In the illustrated embodiment, the second support cylinder 324 is partially disposed within the second cavity 120 of the chassis 104. However, it should be appreciated that in alternative embodiments, the second support cylinder may be positioned at another suitable location on the work vehicle chassis. In certain embodiments, a control system may be configured to extend and retract the support cylinders concurrently, such that the support cylinders apply substantially equal forces to the arm.

Figure 3:
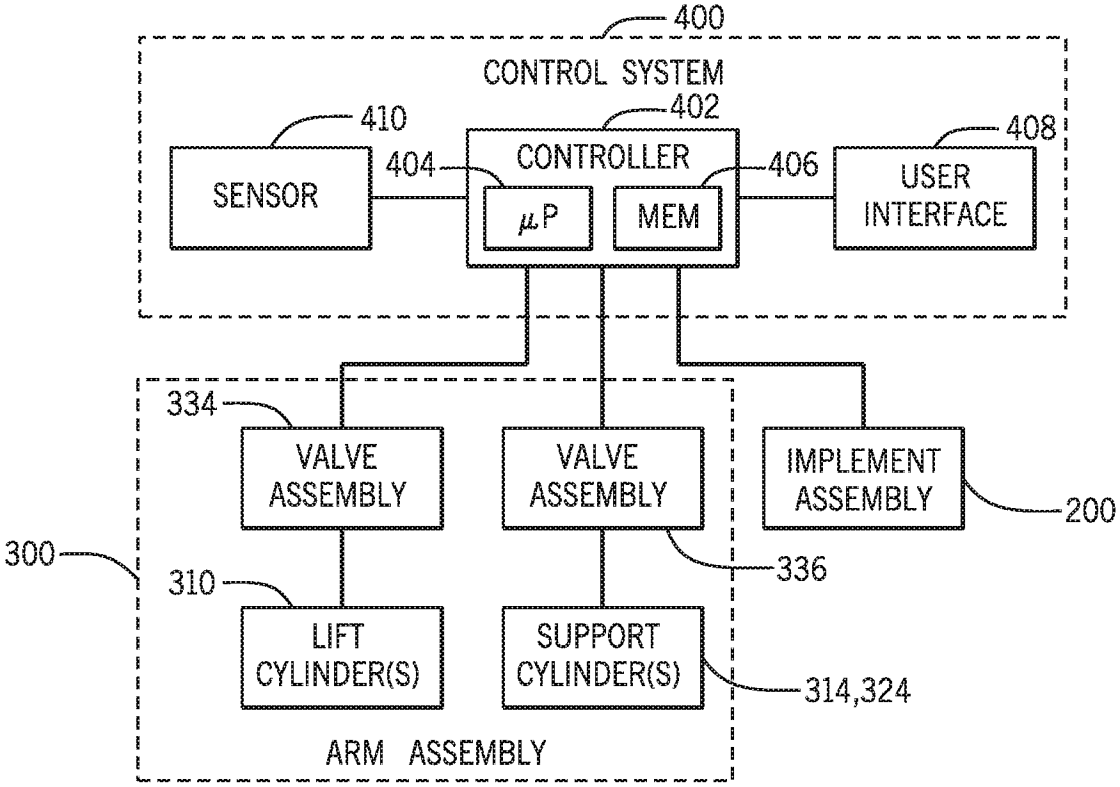
FIG. 3 is a schematic diagram of an embodiment of a control system that may be used to control the arm assembly of FIG. 1.

FIG. 3 is a schematic diagram of an embodiment of a control system 400 that may be used to control the arm assembly 300 of FIG. 1. As previously discussed, the arm assembly 300 includes the lift cylinders 310 and the support cylinders 314, 324. In the illustrated embodiment, the lift cylinders 310 and the support cylinders 314, 324 are hydraulic cylinders. Accordingly, the arm assembly 300 includes a first valve assembly 334 configured to control fluid flow to and from the lift cylinders 310, and a second valve assembly 336 configured to control fluid flow to and from the support cylinders 314, 324. The first and second valve assemblies 334, 336 are communicatively coupled to a controller 402 of the control system 400. The controller 402 is configured to control extension and retraction of the lift cylinders 310 by instructing the first valve assembly 334 to control fluid flow to/from the lift cylinders. In addition, the controller 402 is configured to control extension and retraction of the support cylinders 314, 324 by instructing the second valve assembly 336 to control fluid flow to/from the support cylinders. In certain embodiments, the lift cylinders and/or the support cylinders may be pneumatic cylinder(s)/actuator(s). In such embodiments, the valve assembly/assemblies may be configured to control air flow to/from the pneumatic cylinder (s)/actuator(s). In further embodiments, the lift cylinders and/or the support cylinders may be electromechanical actuator(s). In such embodiments, the controller may be communicatively coupled directly to the electromechanical actuator(s).

In certain embodiments, the controller 402 is an electronic controller having electrical circuitry configured to process data associated with operation of the lift cylinders and/or the support cylinders. In the illustrated embodiment, the controller 402 include a processor, such as the illustrated microprocessor 404, and a memory device 406. The controller 402 may also include one or more storage devices and/or other suitable components. The processor 404 may be used to execute software, such as software for controlling the lift cylinders 310 and/or the support cylinders 314, 324, and so forth. Moreover, the processor 404 may include multiple microprocessors, one or more "general-purpose" microprocessors, one or more special-purpose microprocessors, and/or one or more application specific integrated circuits (ASICS), or some combination thereof. For example, the processor 404 may include one or more reduced instruction set (RISC) processors.

The memory device 406 may include a volatile memory, such as random access memory (RAM), and/or a nonvolatile memory, such as read-only memory (ROM). The memory device 406 may store a variety of information and may be used for various purposes. For example, the memory device 406 may store processor-executable instructions (e.g., firmware or software) for the processor 404 to execute, such as instructions for controlling the lift cylinders 310 and/or the support cylinders 314, 324, and so forth. The storage device (s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for controlling lift cylinders 310 and/or the support cylinders 314, 324, etc.), and any other suitable data.

The controller 402 is configured to control extension and retraction of the lift cylinders 310 and the support cylinders 314, 324 (e.g., in response to operator input). For example, in the illustrated embodiment, the control system 400 includes a user interface 408 communicatively coupled to the controller 402. The user interface 408 may include a display (e.g., a touch screen display), controls, other input devices and/or output devices, or a combination thereof. For example, the operator may operate controls of the user interface 408 to control the position of the implement assembly 200 (e.g., the dozer blade of the implement assembly).

In certain embodiments, the controller 402 is configured to control the support cylinders 314, 324 based at least in part on a position of the arm. For example, an operator may instruct the lift cylinders 310 to extend (e.g., via the user interface 408). As the lift cylinders 310 extend, the arm rotates upwardly, thereby increasing the height of the implement assembly 200 (e.g., the dozer blade of the implement assembly) relative to the ground. In addition, rotation of the arm moves the cross-member away from the second ends/stops of the support cylinders 314, 324. Accordingly, the controller 402 may be configured to automatically instruct the support cylinders 314, 324 to extend (e.g., via the valve assemblies 334, 336) based on the position of the arm, such that the second ends/stops of the support cylinders 314, 324 contact/engage the arm (e.g., the cross-member of the arm). For example, in certain embodiments, the control system 400 includes a sensor 410 communicatively coupled to the controller 402. The sensor 410 is configured to output a signal indicative of the position of the arm (e.g., relative to the chassis, relative to the second ends/stops of the support cylinders, etc.). The controller 402 may be configured to control the support cylinders 314, 324 based on feedback from the sensor, such that the second ends/stops of the support cylinders 314, 324 contact/engage the arm (e.g., the cross-member of the arm) before earth-moving operations are initiated. In certain embodiments, the sensor may include an inductive sensor, a capacitance sensor, an infrared sensor, an ultrasonic sensor, any other sensor suitable for determining the position of the arm, or a combination thereof.

In certain embodiments, the controller 402 may be configured to automatically instruct the support cylinders 314, 324 to retract (e.g., via the valve assemblies 334, 336) in response to instructions to lower the arm. For example, an operator may instruct the lift cylinders 310 to retract (e.g., via the user interface 408), such that the arm rotates to a target orientation (e.g., an orientation that positions the dozer blade at a target height relative to the ground). The controller 402, in turn, may be configured to automatically instruct the support cylinders 314, 324 to retract, such that the second ends/stops of the support cylinders 314, 324 contact/engage the arm (e.g., the cross-member of the arm) as the arm reaches the target orientation. The controller 402 may then instruct the lift cylinders 310 to retract.

In certain embodiments, automatic control of the support cylinders 314, 324 may be initiated upon activation of a dozer operating mode. For example, in certain embodiments, the dozer operating mode may be activated in response to manual input (e.g., via the user interface 408). In further embodiments, the dozer operating mode may be automatically activated in response to detection of a dozer blade coupled to the arm. For example, in certain embodiments, the implement assembly 200 may be communicatively coupled to the controller 402 (e.g., via an ISOBUS, etc.). The controller may be configured to automatically detect the type of implement coupled to the arm based on a signal sent from the implement assembly to the controller. Accordingly, when the controller receives a signal indicative of attachment of a dozer blade to the arm, the controller may automatically activate the dozer operating mode. Furthermore, in certain embodiments, the control system may include a sensor configured to detect the type of implement coupled to the arm. In such embodiments, the controller may be configured to automatically activate the dozer operating mode based on feedback from the sensor. Upon activation of the dozer operating mode, the controller may be configured to initiate automatic control of the support cylinders. Furthermore, upon deactivation of the dozer operating mode (e.g., in response to automatic detection of a non-dozer implement, in response to manual input, etc.), the controller may instruct the support cylinders to fully retract, thereby enabling the arm to rotate to any suitable target position between a fully lowered position and a fully raised position. While automatic control of the support cylinders 314, 324 is disclosed above, in certain embodiments, the extension and retraction of the support cylinders 314, 324 may be manually controlled (e.g., via the user interface 408).

While only certain features have been illustrated and described herein, many modifications and changes will occur to those skilled in the art. It is, therefore, to be understood that the appended claims are intended to cover all such modifications and changes as fall within the true spirit of the disclosure.

The invention claimed is:

1. An arm assembly for a work vehicle, comprising:

an arm configured to rotatably couple to a chassis of the work vehicle, wherein the arm includes a substantially vertical portion, and the substantially vertical portion is configured to support an implement;

a lift actuator coupled to the arm and configured to couple to the chassis of the work vehicle, wherein the lift actuator is configured to rotate the arm relative to the chassis to control a position of the implement along a vertical axis; and a support actuator configured to couple to the chassis, wherein the support actuator is configured to engage the substantially vertical portion of the arm to support the arm against a horizontal load applied to the arm by the implement;

wherein the support actuator comprises a stop at a second end of the support actuator, and wherein the stop is configured to engage the arm to support the arm against the horizontal load.

2. The arm assembly of claim 1, wherein the support actuator is configured to be partially disposed within a cavity of the chassis.

3. The arm assembly of claim 1, further comprising a bracket configured to rotatably couple a first end of the support actuator to the chassis.

4. The arm assembly of claim 1, wherein the stop is configured to engage a cross-member of the arm to support the arm against the horizontal load.

5. The arm assembly of claim 1, further comprising a controller configured to control the support actuator based at least in part on a position of the arm.

6. The arm assembly of claim 5, further comprising a sensor communicatively coupled to the controller, wherein the sensor is configured to output a signal indicative of the position of the arm.

7. The arm assembly of claim 1, further comprising a second support actuator configured to couple to the chassis, wherein the second support actuator is configured to engage the substantially vertical portion of the arm to support the arm against the horizontal load.

8. An arm assembly for a work vehicle, comprising:

an arm configured to rotatably couple to a chassis of the work vehicle, wherein the arm is configured to support an implement; and a support actuator having a first end and a second end, wherein the first end is configured to couple to the chassis, the second end is configured to selectively engage the arm to support the arm against a horizontal load applied to the arm by the implement, and the second end is not coupled to the arm;

wherein the support actuator comprises a stop at a second end of the support actuator, and wherein the stop is configured to selectively engage the arm to support the arm against the horizontal load.

9. The arm assembly of claim 8, wherein the support actuator is configured to be partially disposed within a cavity of the chassis.

10. The arm assembly of claim 8, further comprising a bracket configured to rotatably couple the first end of the support actuator to the chassis.

11. The arm assembly of claim 8, wherein the stop is configured to selectively engage a cross-member of the arm to support the arm against the horizontal load.

12. The arm assembly of claim 8, further comprising a controller configured to control the support actuator based at least in part on a position of the arm.

13. The arm assembly of claim 12, further comprising a sensor communicatively coupled to the controller, wherein the sensor is configured to output a signal indicative of the position of the arm.

14. The arm assembly of claim 8, further comprising a second support actuator having a first end and a second end, wherein the first end of the second support actuator is configured to couple to the chassis, the second end of the second support actuator is configured to selectively engage the arm to support the arm against the horizontal load, and the second end of the second support actuator is not coupled to the arm.

15. A work vehicle, comprising a chassis and an arm assembly, wherein the arm assembly comprises:

an arm rotatably coupled to the chassis, wherein the arm includes a substantially vertical portion, and the substantially vertical portion is configured to support an implement;

a lift actuator coupled to the arm and to the chassis, wherein the lift actuator is configured to rotate the arm relative to the chassis to control a position of the implement along a vertical axis; and a first support actuator coupled to the chassis, wherein the first support actuator is configured to engage the substantially vertical portion of the arm to support the arm against a horizontal load applied to the arm by the implement;

wherein the first support actuator comprises a stop at a second end of the first support actuator, and wherein the stop is configured to selectively engage the arm to support the arm against the horizontal load.

16. The work vehicle of claim 15, wherein the chassis includes a first cavity, and the first support actuator is partially disposed within the first cavity.

17. The work vehicle of claim 15, further comprising a second support actuator coupled to the chassis, wherein the second support actuator is configured to engage the substantially vertical portion of the arm to support the arm against the horizontal load.

18. The work vehicle of claim 17, wherein the chassis includes a first cavity positioned on a first lateral side of the chassis, the chassis includes a second cavity positioned on a second lateral side of the chassis, opposite the first lateral side, the first support actuator is partially disposed within the first cavity, and the second support actuator is partially disposed within the second cavity.

19. The work vehicle of claim 15, further comprising a controller configured to control the first support actuator based at least in part on a position of the arm.

20. The work vehicle of claim 19, further comprising a sensor communicatively coupled to the controller, wherein the sensor is configured to output a signal indicative of the position of the arm.

* * * * *